US012152382B1

(12) United States Patent
Rodriguez

(10) Patent No.: US 12,152,382 B1
(45) Date of Patent: Nov. 26, 2024

(54) CLEANSING ASSEMBLY FOR AN INDIVIDUAL

(71) Applicant: George Rodriguez, Miami, FL (US)

(72) Inventor: George Rodriguez, Miami, FL (US)

( * ) Notice: Subject to any disclaimer, the term of this patent is extended or adjusted under 35 U.S.C. 154(b) by 35 days.

(21) Appl. No.: 17/874,143

(22) Filed: Jul. 26, 2022

(51) Int. Cl.
*E03D 9/08* (2006.01)
*E03D 9/052* (2006.01)

(52) U.S. Cl.
CPC ..... *E03D 9/08* (2013.01); *E03D 9/052* (2013.01)

(58) Field of Classification Search
CPC ..... E03D 9/08; E03D 9/052
USPC ..... 4/420.4, 420.5, 422, 447, 448
See application file for complete search history.

(56) References Cited

U.S. PATENT DOCUMENTS 5,519,897 A * 5/1996 DeSimone ..... E03D 9/052 4/213
6,192,527 B1 * 2/2001 Paul ..... E03D 11/025 4/420.4
6,539,557 B1 * 4/2003 Avila ..... A47K 13/10 4/240
6,772,450 B1 * 8/2004 Saylor ..... E03D 9/005 4/223
8,332,969 B2 * 12/2012 Spadola ..... E03D 9/052 4/227.1
9,512,604 B1 * 12/2016 Hunter ..... E03D 9/052
2006/0085897 A1 * 4/2006 Birdsong ..... E03D 9/05 4/213
2007/0136937 A1 * 6/2007 Sawalski ..... B65D 83/20 4/223
2007/0240250 A1 * 10/2007 Foerster ..... E03D 9/052 4/213
2007/0289053 A1 * 12/2007 Tolbert ..... E03D 9/052 4/213
2008/0083056 A1 * 4/2008 Damianoe ..... E03D 9/052 4/213
2009/0158515 A1 * 6/2009 Bruno ..... E03D 9/052 4/209 R
2010/0199413 A1 * 8/2010 Pollack ..... E03D 9/052 4/213
2011/0047686 A1 * 3/2011 Moore ..... E03D 9/052 4/213
2013/0263366 A1 * 10/2013 Prete ..... A47K 13/307 4/209 R (Continued)

FOREIGN PATENT DOCUMENTS

WO WO-2011055356 A1 * 5/2011 ..... E03D 1/24
WO WO-2018186541 A1 * 10/2018 ..... E03D 9/052

*Primary Examiner* — Lori L Baker
(74) *Attorney, Agent, or Firm* — MALLOY & MALLOY, PL

(57) ABSTRACT

A cleansing assembly operative to clean an individual after use of a toilet bowl including a delivery conduit mounted within the toilet bowl beneath and adjacent to an outer rim of a bowl opening. An intake conduit is disposed in interconnecting relation between the delivery conduit and a water supply and at least partially defines a path of fluid flow of water therethrough from the water supply to and within said delivery conduit. A spout on the delivery conduit is disposed and structured to direct a forced flow of fluid onto a portion of an individual exposed through the toilet opening and a control assembly is connected to the inlet conduit in flow regulating relation to water passing along the path of fluid flow. An odor removal assembly is provided to eliminate or restrict odors resulting from the use of the toilet bowl.

19 Claims, 5 Drawing Sheets

(56) References Cited

U.S. PATENT DOCUMENTS

| | | | | |
|---|---|---|---|---|
| 2013/0276220 | A1* | 10/2013 | Cogswell | E03D 9/052 4/352 |
| 2014/0137317 | A1* | 5/2014 | Sollami | E03D 9/05 4/213 |
| 2014/0304903 | A1* | 10/2014 | Cogswell | E03D 9/052 4/314 |
| 2015/0292189 | A1* | 10/2015 | Chavez | E03D 9/052 4/213 |
| 2016/0186421 | A1* | 6/2016 | Lammel | E03D 9/08 4/420.5 |
| 2019/0292760 | A1* | 9/2019 | Finkbeiner | E03D 9/052 |
| 2021/0207355 | A1* | 7/2021 | Finkbeiner | E03D 9/052 |
| 2022/0018106 | A1* | 1/2022 | Goolsby | A61L 9/20 |
| 2022/0081888 | A1* | 3/2022 | Marion | A01K 1/0052 |
| 2022/0243442 | A1* | 8/2022 | Wanderi | E03D 9/005 |
| 2023/0111907 | A1* | 4/2023 | Marion | E03C 1/284 4/209 R |
| 2023/0366189 | A1* | 11/2023 | Wilson | E03D 9/05 |
| 2023/0399835 | A1* | 12/2023 | Marion | E03D 1/35 |

* cited by examiner

CLEANSING ASSEMBLY FOR AN INDIVIDUAL

BACKGROUND OF THE INVENTION

Field of the Invention

This invention is directed to a cleansing assembly for an individual used with an operatively connected to a conventional toilet. The assembly is mounted on the toilet bowl and, using a forced flow of water, is operative to clean a portion of an individual exposed through the opening of the toilet bowl.

DESCRIPTION OF THE RELATED ART

An apparatus operative to wash and clean body parts which are exposed while using a toilet and/or toilet bowl may be commonly referred to as a bidet. Common usage of such structures, perhaps more predominantly in Europe, resulted in various types of structure, designs, operative features, installations, etc.

More sophisticated or complex cleansing apparatus of this type may typically include permanent installation of plumbing components and features built into the wall of a bathroom or other location site where the toilet is placed and used. However, these more permanent installed cleansing apparatus have proven to be expensive, both to purchase and install, frequently requiring modification of bathroom walls, floors, etc.

As a result, new generations of the bidets were developed in odor to overcome excessive expense and inconveniences. Such new developments may be attachable to the toilet structure, and/or different parts thereof such as the toilet seat. Nozzles and other water issuing structures are also connected to or mounted on appropriate portions of the toilet bowl and disposed thereon in a manner which facilitates cleansing of the private parts of an individual.

Moreover, various types of designs, structures, components and operative features have been developed in this industrial area to overcome known and recognized disadvantages of the type set forth above, as well as numerous others relating to the effective use and operation. Such additional features were also provided and/or enhanced to make bidet structures more appealing from a commercial standpoint. Such complementary features may include temperature regulated water, drying facilities, disinfectant capabilities as well as structural and operative features directed to the cleansing of the bidet structure itself.

More specifically, pollution of the outer surface of nozzles and the toilet components or areas to which the bidet is mounted are commonly recognized as causing hygienic problems to the use and maintenance of such cleansing apparatus. Such hygienic concerns are particularly important in bidets used in areas for maintaining the infirm or ill. Obviously, there is a particular concern when dealing with such individuals of being especially cautious about maintaining hygiene of the surrounding environment in odor to prevent infections, etc.

Accordingly, there is a need in this area of individual hygiene for a more simple, uncomplicated individual cleansing assembly, which is easily installed yet effectively operable to perform the intended hygiene on individuals. Such a preferred and proposed cleansing assembly may include minimal operable components yet be reliable in operation while easy to maintain both structurally and from the standpoint of pollution or cleanliness. Further, the structural and operative features of such a preferred and proposed individual cleansing assembly should facilitate its use in a variety of different environments in combination with the structural mounting or connection to a toilet bowl of varying sizes and configurations. Also, operational features of such a preferred individual cleansing assembly should be such as to be selectively manual thereby further simplifying its installation and use.

SUMMARY OF THE INVENTION

The present invention is directed to a cleansing assembly operative to cleanse individuals after the use of or supported in a seated orientation on the bowl of the toilet. The simplicity and versatility of the various structural components of the assembly of the present invention are such as to be easily mounted on or connected to most conventional toilets, regardless of the size, shape and/or location thereof.

More specifically, the cleansing assembly of the present invention comprises a delivery conduit connected to the toilet bowl in adjacent relation to the conventional entrance or opening of the toilet bowl. A spout structure is disposed on or formed in the delivery conduit at a predetermined location to direct a forced flow of water onto the portion of the individual, which is exposed to the interior of the toilet bowl via the opening of the bowl.

In addition, an intake conduit is disposed at least partially on the exterior of the toilet bowl in interconnecting relation between a water supply and the delivery conduit. As such, the intake conduit at least partially defines a path of fluid flow of the water, from the water supply, to and through the delivery conduit, to the spout structure disposed on the delivery conduit. It is of note that the term "water supply" is meant to include, but not be limited to the water supply of the home and/or building associated with the location of the toilet, wherein such water supply may also be used to supply water to the water tank or like water collection structure associated with the toilet, with which the cleansing assembly is operative. Therefore, in at least one embodiment, the inlet conduit may have an independent or common connection to the water supply as compared to the water tank of the toilet. Therefore, the intake conduit may receive water directly from the water supply, independent of the water tank of the toilet or in the alternative may receive water directly from the water tank or other water collection structure associated with the toilet.

Additional structural and operative features of the cleansing assembly of the present invention include a control assembly connected to the inlet conduit in flow regulating relation to water passing therethrough, along the path of flow from the water supply to the delivery conduit and spout structure. Moreover, the control assembly may include at least one valve structure disposable between a flow-on orientation and a flow-off orientation. In at least one embodiment the control assembly is located exteriorly of the toilet bowl directly in fluid communication with the interior of the inlet conduit and in regulating/restricting relation to water flow along the path of travel. As indicated the control assembly may be manually operative for selective positioning of the one or more valve structures between the aforementioned flow-on and flow-off orientations. For purposes of safety and convenience the control assembly and more specifically the one at least one valve structure operatively associated therewith is normally disposed and/or biased in the flow-off orientation. As a result, when in the flow-off orientation, water does not pass along the aforementioned path of fluid flow, through at least a portion of the inlet conduit, to the delivery conduit and spout structure. Also, the flow-on orientation may be at least partially positioned to further regulate the volume and/or pressure of the water issuing form the spout structure onto the exposed portion of the individual.

This restriction or regulation of water flow in the manner indicated prevents inadvertent or accidental delivery of water to the area of the toilet bowl associated with the opening thereof, such as when an individual is not seated on the toilet bowl seat, over the bowl opening. The selective and preferably manual operation of the control assembly practically assures that water will not be dispersed from the spout structure of the delivery conduit until an individual is properly seated on the toilet seat overlying the toilet bowl. Such manual and selective activation or operation of the control assembly thereby reliably and efficiently accomplishes delivery of the aforementioned forced flow of water onto an exposed portion, to be cleaned of an individual, which is aligned with the bowl opening.

In at least one embodiment, the aforementioned spout structure comprises at least one orifice disposed on and/or formed in the delivery conduit at a predetermined location which will facilitate direction of water dispersed from the delivery conduit onto the exposed portion of an individual's body. In the alternative, one or more embodiments of the present invention may include the spout structure comprising a plurality of orifices disposed in at least minimally spaced relation to one another along a predetermined and preferably common length of the delivery conduit. It is also to be noted that the term "orifice" is also meant to describe any of a variety of nozzles or other fluid directing structures, which may be integrated into and/or with the orifice such that the water from the interior of the delivery conduit is appropriately directed toward the bowl opening and exposed portion of the individual, as set forth above. Moreover, for purposes of convenience, reliability and practicality the one or more orifices at least partially defining the spout structure will be located on a portion delivery conduit disposed at or aligned with the rear portion of the toilet bowl and bowl opening in substantial opposition to a front or leading portion of the toilet bowl and opening thereof.

Yet additional features of one or more embodiments of the cleansing assembly of the present invention comprises the delivery conduit being supported within the toilet bowl adjacent the outer rim thereof. Further, the delivery conduit preferably comprises a curved configuration along at least a portion of its length, where in such curved configuration may extend along and correspond to a substantially curved configuration of the interior portion of the toilet bowl on which it is connected or mounted. In the alternative, the delivery conduit may include a continuous, closed, annular configuration. Such an annular configuration will also substantially conform to the curved configuration of the interior wall of the toilet bowl adjacent the rim of the opening of the bowl opening on which it is connected or mounted. However, in either of these operative embodiments the spout structure whether including one or a plurality of the aforementioned orifices and fluid directing devices are preferably located adjacent a rear portion of the toilet bowl adjacent the rear portion of the bowl opening.

One or more features of the present invention include to an odor removal assembly operative to remove odors from the interior of the toilet bowl by establishing an airflow path from the toilet bowl interior to an exterior of the toilet bowl. More specifically, the odor removal assembly comprises a source of negative pressure, preferably in the form of a fan driven by a fan motor. In addition, the odor removal assembly includes a removal conduit including a removal port disposed on the interior of the toilet bowl and/or indirect fluid communication therewith.

As explained in greater detail hereinafter, additional operative features of the odor removal assembly include the ability to facilitate drying and/or removal of the cleansing water or other liquid from the exposed portion of the user, when positioned on the toilet seat. More specifically, the odor removal assembly is structured to facilitate movement or passage of airflow onto, over or at least in communication with the exposed portion of the user. Accordingly, the creation of the negative pressure airflow by the odor removal assembly, which is established in sufficient strength, quantity and/or direction, is operative to remove liquid particles from the exposed portion of the user's body, while on the user is on seat. As a result, the airflow will facilitate at least partial "drying" of the user due to the establishment of such airflow.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
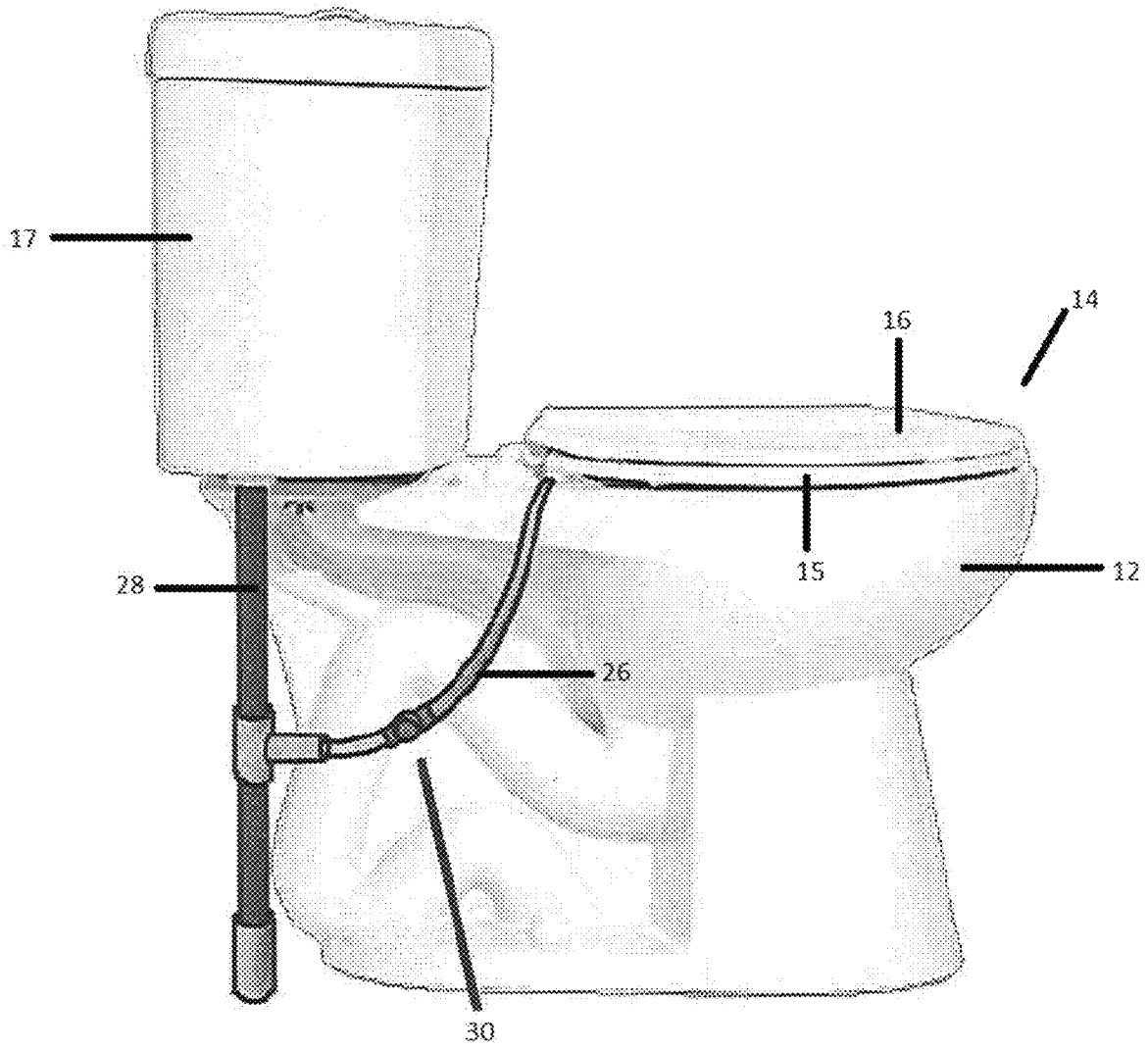
FIG. 1 is a side perspective view of the cleaning assembly of the present invention operatively installed on a conventional toilet bowl.

The invention now will be described more fully hereinafter with reference to the accompanying drawings in which illustrative embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

The present invention is directed to a cleansing assembly, generally indicated as 10, operative to cleanse individuals after the use of or supported in a seated orientation on the bowl 12 of the toilet 14. The simplicity and versatility of the various structural components of the assembly of the present invention are such as to be easily mounted on or connected to most conventional toilets regardless of the size, shape and/or location thereof. Moreover, the toilet 14 may include a toilet seat 15 and a covering lid 16, each movable between an overlying covering position as represented in FIG. 1 or an open position, where in the lid 16 is lifted and pivoted outwardly from the seat 15 so as to expose the seat 15, the opening 18 and the interior 18' of the toilet bowl 12, as represented in FIGS. 2 and 3.

Figure 2:
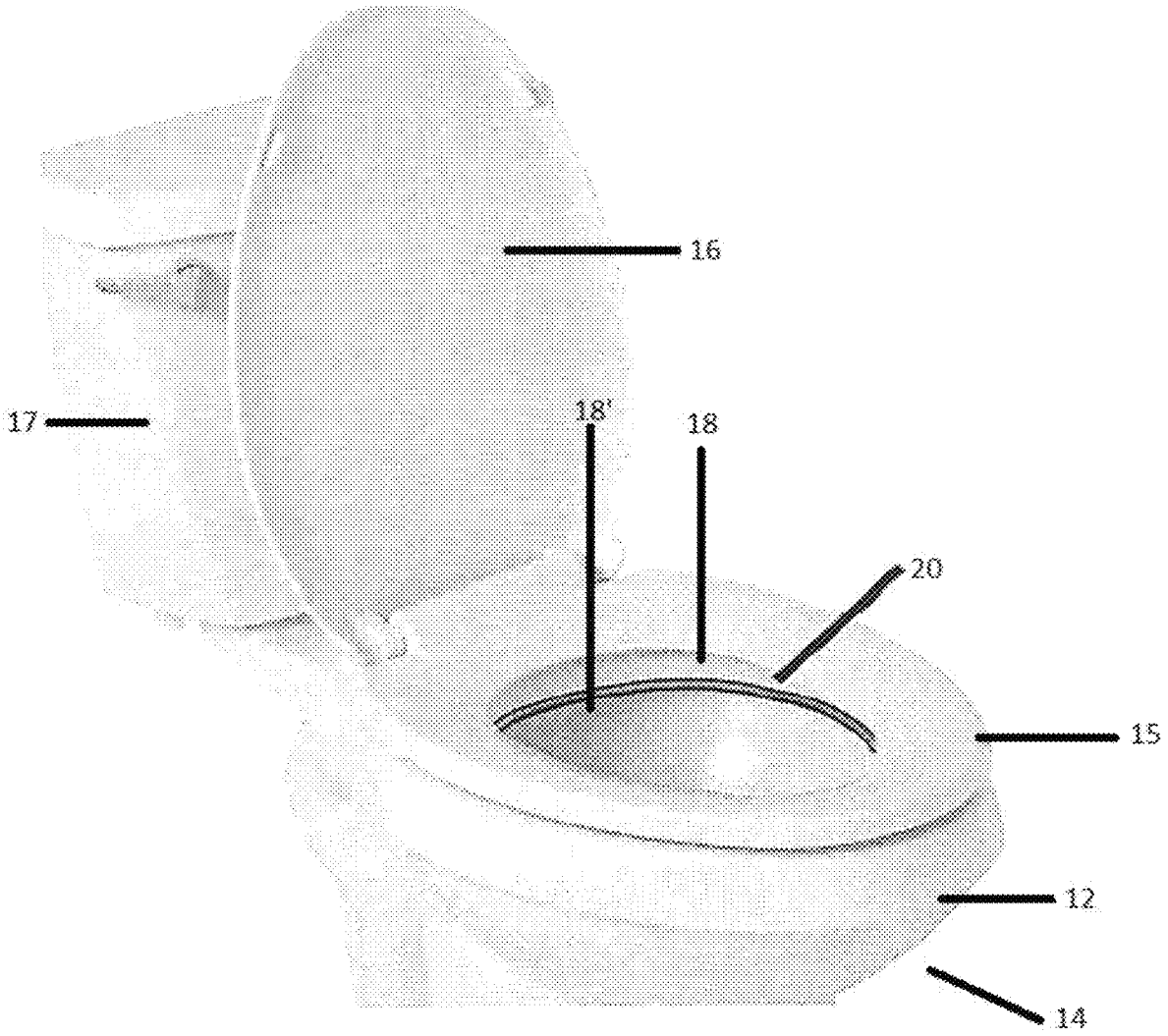
FIG. 2 is a perspective view of the embodiment of FIG. 1 representing a component thereof operatively disposed on the interior of the toilet bowl.
Figure 3:
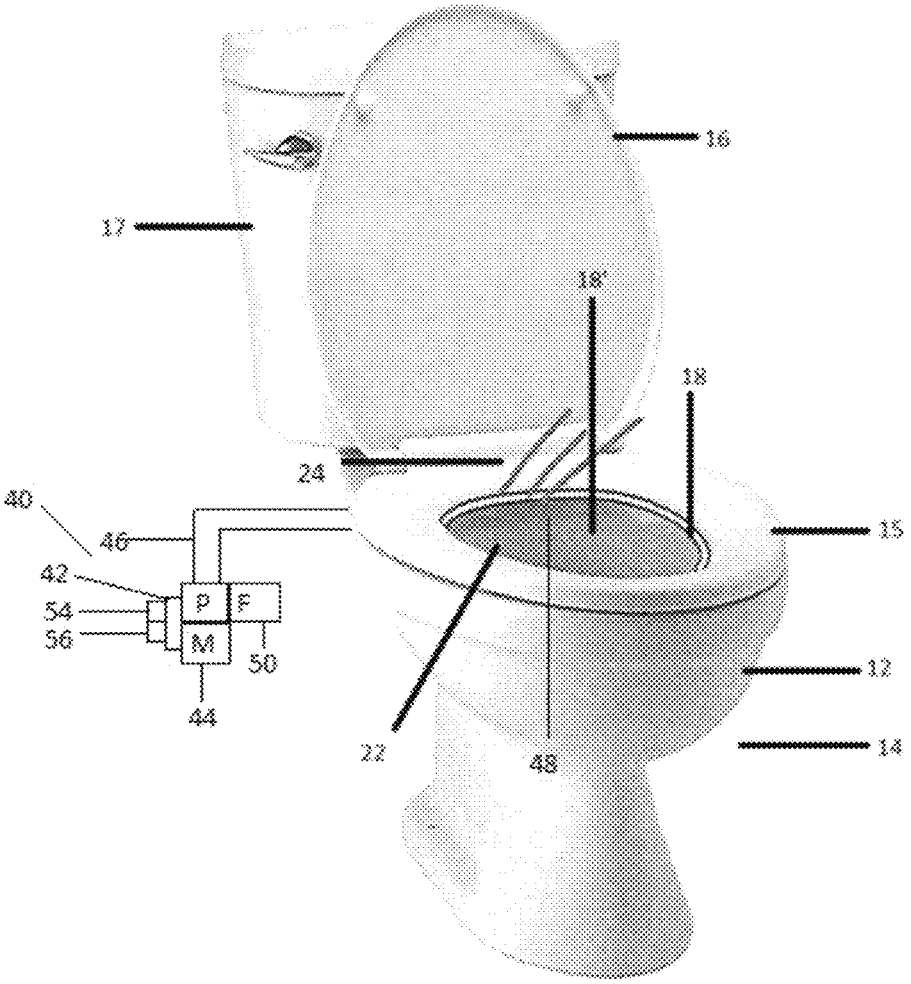
FIG. 3 is a front perspective view of the embodiment of FIGS. 1 and 2.
Figure 5:
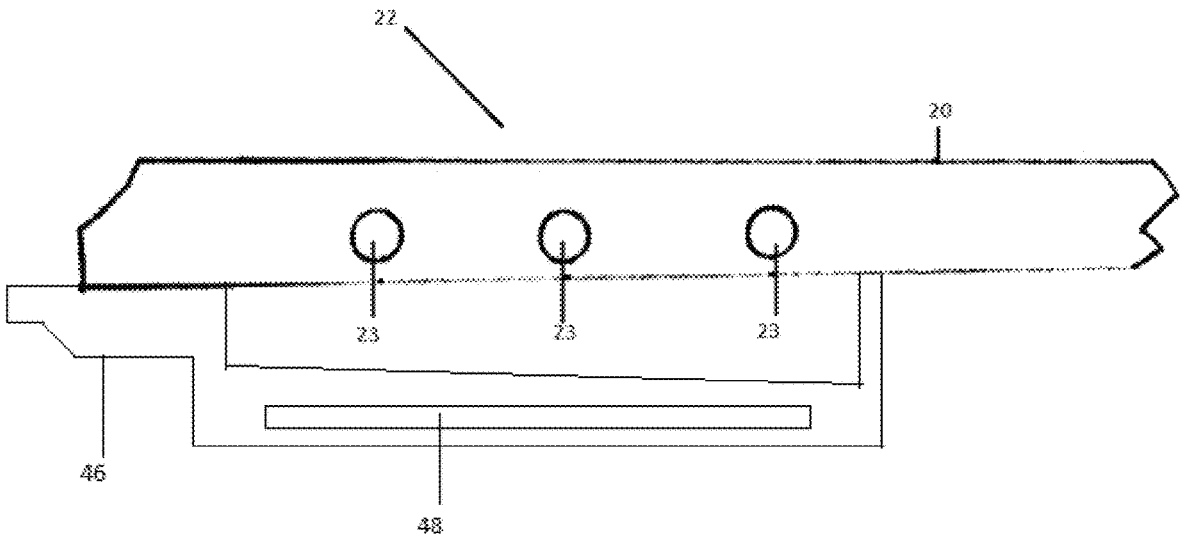
FIG. 5 is a schematic representation in partial cutaway representing operative features of a spout structure and removal port of the embodiments of FIGS. 1-4.

More specifically, the cleansing assembly 10 of the present invention comprises a delivery conduit 20, as represented in FIG. 2, connected to the toilet 14 in adjacent relation to the conventional opening 18 of the toilet bowl 12. A spout structure generally indicated as 22 is schematically represented in FIG. 5 and is disposed on or formed in the delivery conduit 20 at a predetermined location to direct a forced flow of water 24 (see FIG. 3) onto the portion of the individual which is exposed (not shown for purposes of clarity) to the interior 18' of the toilet bowl 14 via the bowl opening 18.

In addition, an intake conduit 26 is disposed at least partially on the exterior of the toilet bowl 12 in interconnecting relation between a water supply 28 and the delivery conduit 20. As such, the intake conduit 26 at least partially defines a path of fluid flow of water, from the water supply 28, to and through the delivery conduit 20 and to the location of the spout structure 22 disposed on the delivery conduit 20. It is to be noted that the term "water supply" is meant to include, but not be limited to the water supply of the home and/or building associated with the location of the toilet 14, wherein such water supply may also be used to supply water to a water tank 17 or like water collection structure associated with the toilet 14, with which the cleansing assembly 10 is operative. However, in at least one embodiment, the inlet conduit 26 may have a common or independent connection to the water supply 28 as compared to the water tank 17 or other water collection structure associated with the toilet 14.

Figure 4:
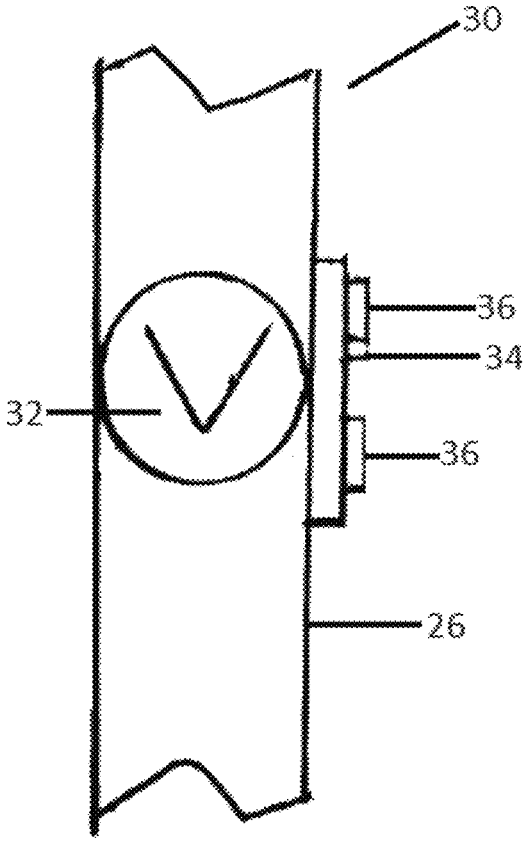
FIG. 4 is a schematic representation in partial cutaway representing operative structure of a control assembly of the embodiments of FIGS. 1-3.

Additional structural and operative features of the cleansing assembly 10 of the present invention include a water control assembly, generally indicated as 30 in FIGS. 1 and 4, connected to the inlet conduit 26 in flow regulating relation to water passing through the inlet conduit 26, along the path of fluid flow from the water supply 28 to the delivery conduit 20 and spout structure 22. Moreover, as schematically represented in FIG. 4, the water control assembly 30 may include at least one valve structure 32 disposable between a flow-on orientation and a flow-off orientation. In at least one embodiment the water control assembly 30 is located exteriorly of the toilet bowl 12 directly in fluid communication with the interior of the inlet conduit 26 and in regulating/restricting relation to water flow along the path of travel, initially within the inlet conduit 26.

As indicated, the water control assembly 30 may be manually operative for selective positioning of the one or more valve structures 32 between the aforementioned flow-on and flow-off orientations. As also represented in FIG. 4, an activation assembly 34 may be mounted on the exterior of the inlet conduit 26, or other appropriate location, within an accessible relation to an individual seated on the seat 15. More specifically, the activation assembly 34 may include one or more activation structures 36 such as buttons, dials, etc. which when manually manipulated by an individual, will serve to dispose the at least one valve 32 in either the flow-on orientation or the flow-off orientation. In addition, the activation structures 36 may be operative to control the volume and/or pressure of the amount of water passing through the intake conduit 26, along the path of fluid flow, to the delivery conduit 20 and spout structure 22 by regulating the position of the one or more valves 32 to assume various degrees of "openness" of the flow-on orientation.

For purposes of safety and convenience the water control assembly 30 and more specifically the at least one valve structure 32 is normally disposed and/or biased in the flow-off orientation. As a result, when in the flow-off orientation, water does not pass along the aforementioned path of fluid flow, through at least a portion of the inlet conduit 26, to the delivery conduit 20 and spout structure 22. This restriction or regulation of water flow in the manner indicated prevents inadvertent or accidental delivery of water to and/or through the opening 18, such as when an individual is not in a seated orientation on the toilet bowl seat 15, over the bowl opening 18. The selective and preferably manual operation of the water control assembly 30 assures that water will not be inadvertently dispersed from the spout structure 22 of the delivery conduit 20 until an individual is properly seated on the toilet seat 15 overlying the opening 18 and interior 18' of the toilet bowl 14. Such manual activation or operation of the water control assembly 30 thereby reliably and efficiently accomplishes delivery of the aforementioned forced flow of water 24 (see FIG. 3) onto an exposed portion of an individual, which is aligned with the bowl opening 18.

In at least one embodiment schematically represented in FIG. 5, the aforementioned spout structure 22 comprises at least one orifice 23 disposed on and/or formed in the delivery conduit at a predetermined location which will facilitate direction of water dispersed from the delivery conduit 20 onto the exposed portion of an individual's body. In the alternative, one or more embodiments of the present invention may include the spout structure 22 comprising a plurality of orifices 23 disposed in at least minimally spaced relation to one another along a predetermined and preferably common length of the delivery conduit 20. It is also to be noted that the term "orifice" is also meant to describe any of a variety of nozzles or fluid directing structures which may be directly integrated into and/or operable with the orifice such that the water from the interior of the delivery conduit 20 is appropriately directed toward the bowl opening 18 and exposed portion of the individual, as set forth above. Moreover, as represented in FIG. 3, for purposes of enhanced performance and practicality, the one or more orifices 23, at least partially defining the spout structure 22, will be located on a portion of the delivery conduit 20 disposed at or aligned with the rear portion of the toilet bowl 14 and bowl opening 18 in substantial opposition to a front or leading portion of the toilet bowl 14 and opening 18.

One or more structural and operative features of the assembly of the present invention are directed to an odor removal assembly, generally indicated as 40 in FIG. 3. The odor removal assembly is operative to remove odors from the interior 18' of the toilet bowl 12 by establishing an airflow path from the toilet bowl interior 18' to an exterior of the toilet bowl 12. More specifically, the odor removal assembly 40 comprises a source of negative pressure preferably in the form of a fan 42 driven by a fan motor 44. In addition, the odor removal assembly 40 includes a removal conduit 46 including a removal port 48, as schematically represented in FIG. 5. The removal port 48 is disposed on the interior 18' of the toilet bowl 12 and/or indirect fluid communication with the toilet bowl interior 18'.

As represented in both FIGS. 3 and 5 the removal conduit 46 extends from the fan 42 to the interior 18' of the toilet bowl 12 by extending beneath the seat 15 at any point along the top of the toilet bowl 12, such as along the side of the seat 15 or along a rear portion thereof. As represented in FIG. 3, the segment of the removal conduit 46 connected to the removal port 48, as well as the removal port 48 itself may be disposed adjacent to and beneath the water delivery conduit 20 preferably, but not exclusively, adjacent a rear end portion of the toilet bowl 12. However, an operative location of the removal port 40 and associated end portion of the removal conduit 46 may be effectively disposed at other locations from that represented in FIG. 3, provided that the removal port 48 is disposed in fluid communication with the interior 18' of the toilet bowl 12, so as to collect odors present therein.

The odor removal assembly 40, including at least the fan 42 and fan motor 44 as well as operative components associated therewith, may be supported by a bracket or other connecting structure (not shown for purposes of clarity) directly and/or adjacent to the toilet bowl 12. In the alternative, the odor removal assembly 40 may be disposed adjacent an exterior of the toilet bowl 12, such as on surrounding portions of the floor, a supporting surface, etc.

The odor removal assembly 40 also includes a fan control structure 52 including operative buttons, dials, etc. 54 and 56 which provide a manual activation of the fan 42 so as to dispose it in a fan-off condition or a fan-on condition. The fan control structure 52 is preferably, but not necessarily operated and/or controlled separately from the water control assembly 30, as schematically represented in FIG. 4.

Accordingly, the odor removal assembly 40 is operative to define an airflow path from the interior 18' of the toilet bowl 12 to an exterior thereof such as through a housing associated with the odor removal assembly 42 and air filter structure 50. While not represented in detail, the air filter structure 50 can include one or more conventional or known air filtering components, substances etc. so as to remove or restrict odor, resulting from the usage of the toilet 14 from entering the surrounding environment of the toilet 14 after use thereof.

Further, the fan 42, which defines the source of negative pressure, is operative to direct airflow, along the airflow path from the interior 18' of the toilet bowl, through the removal port 48, along the length of the removal conduit 46 to the fan 42 and downstream thereof to the filter structure 50. Once the potentially odor laden air is removed from the interior 18' of the toilet bowl 12, along the airflow path to and through the filter 50, it may be exited into the area surrounding the toilet 14. In the alternative, the filter 50 may be connected by appropriately disposed and structured exhaust conduits to an exhaust location separate and or removed from the area surrounding the toilet 14.

Yet additional operative features of the odor removal assembly 40 is the ability to facilitate drying and/or removal of the cleansing water or other liquid from the exposed portion of the user, when positioned on the seat 15. More specifically, the fan 42 and the removal port 48 are cooperatively structured to facilitate movement or passage of the aforementioned airflow onto, over or at least in communication with the exposed portion of the user. As indicated, the cleansing assembly 10 upon activation is operative to direct a forced flow of water or possibly other cleansing's liquid from the spout 22, onto the exposed portion of the user subsequent or concurrent to use of the toilet 14. Accordingly, features of the odor removal assembly 40 is the creation of the airflow in sufficient strength, quantity and/or direction, to remove liquid particles from the exposed portion of the user's body, while on the user is on seat 15. As a result, the airflow will facilitate the "drying" of the user due to the airflow as established herein. However, it is also noted that any water or water particles removed from the user during operation of the fan 42 will not necessarily or intentionally pass into the removal port 48 and/or through the removal conduit 46 as the negative pressure airflow path, created by the fan 42 passes to and through the filter 50.

Yet additional features of one or more embodiments of the cleansing assembly of the present invention comprises the delivery conduit 20 being supported within the interior 18' of the toilet bowl adjacent the outer rim thereof as represented in at least FIGS. 1 and 3. Further, the delivery conduit 20 preferably comprises a curved configuration along at least a portion of its length, wherein the length and such a curved configuration thereof may extend along and correspond to a substantially curved configuration of the rear surface of the interior 18', substantially opposed to the front or leading portion of the bowl 12. In the alternative, the delivery conduit 20 may include a continuous, closed, annular configuration. Such an annular configuration will also be shaped to substantially conform to the curved configuration of the interior wall or surface of the interior 18', of the toilet bowl 14 adjacent and along the length of the rim of the opening 18 of the toilet bowl 14. However, in either of these operative embodiments the delivery conduit 20 and spout structure 22, whether including one or a plurality of the aforementioned orifices 23 and associated fluid directing devices, are preferably, but not necessarily, located adjacent the rear portion of the bowl opening 18.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. An assembly operative to cleanse an individual in use of a toilet bowl, said assembly comprising:

a delivery conduit connected to the toilet bowl in adjacent relation to a bowl opening, a spout structure disposed on said delivery conduit, said spout structure operative to direct a forced flow of fluid onto a portion of an individual exposed, through the bowl opening, an intake conduit disposed in interconnecting relation between said delivery conduit and a water supply, said intake conduit at least partially defining a path of fluid flow from the water supply to and through said delivery conduit, an odor removal assembly, including a negative pressure source, disposed in fluid communication with a toilet bowl interior, and said odor removal assembly operative to define an airflow path from the toilet bowl interior to a toilet bowl exterior and comprising a removal conduit interconnecting said negative pressure source to the toilet bowl interior and at least partially defining said air flow path, and an air filter structure disposed along said airflow path downstream of said negative pressure source.

2. The assembly as recited in claim 1 wherein said removal conduit comprises a removal port disposed in fluid communication with the toilet bowl interior.

3. The assembly as recited in claim 1 wherein said source of negative pressure comprises a fan operative to direct airflow along said airflow path from the toilet bowl interior to said air filter.

4. The assembly as recited in claim 1 further comprising a control assembly connected to said inlet conduit in flow regulating relation to water passing along said path of fluid flow.

5. The assembly as recited in claim 4 wherein said control assembly comprises a valve structure disposable between a flow-off orientation and the flow-on orientation.

6. The assembly as recited in claim 5 wherein said valve structure is normally disposed in said flow-off orientation.

7. The assembly as recited in claim 1 wherein said spout structure includes at least one orifice disposed and oriented to direct said forced fluid flow onto portions of the individual exposed through the bowl opening, concurrent to said flow-on orientation of said valve.

8. The assembly as recited in claim 7 wherein said at least one orifice is disposed on said delivery conduit adjacent a rear of the toilet bowl and the bowl opening.

9. The assembly as recited in claim 7 wherein said spout structure comprises a plurality of orifices disposed in fluid communication with said path of fluid flow; each of said plurality of orifices disposed and structured to direct said forced fluid flow onto an exposed portion of the individual, through the bowl opening, concurrent to said flow-on orientation of said valve.

10. The assembly as recited in claim 9 wherein said plurality of orifices are collectively disposed on said delivery conduit adjacent a rear of the toilet bowl and the bowl opening.

11. The assembly as recited in claim 1 wherein said delivery conduit comprises a substantially continuous, annular configuration extending along and substantially corresponding to a curved length of the toilet bowl adjacent and beneath the outer rim of the bowl opening.

12. The assembly as recited in claim 1 wherein said airflow path is operative to direct airflow in fluid communicating, at least partially drying relation to exposed portions of the user on the toilet bowl.

13. An assembly operative to cleanse an individual after use of a toilet bowl, said assembly comprising:

a delivery conduit mounted within the toilet bowl beneath and adjacent to an outer rim of a bowl opening, and an intake conduit disposed in interconnecting relation between said delivery conduit and a water supply, said intake conduit at least partially defining a path of fluid flow of water therethrough from the water supply to and within said delivery conduit, a spout structure formed on said delivery conduit in fluid communication with said path of fluid flow and disposed and structured to direct a forced flow of water onto a portion of an individual exposed through the toilet opening, an odor removal assembly, including a negative pressure source, disposed in fluid communication with a toilet bowl interior and operative to define an airflow path from the toilet bowl interior to a toilet bowl exterior, and said source of negative pressure comprises a fan operative to direct airflow along said airflow path from the toilet bowl interior to an exterior thereof, said spout structure comprising at least one orifice disposed and structured to direct said forced fluid flow from said path of fluid flow onto the portion of the individual exposed through the toilet opening, and a water control assembly, including a valve assembly connected to said inlet conduit in flow regulating relation water passing along said path of fluid flow; said valve structure disposable between a flow-off orientation and the flow-on orientation and normally disposed in said flow-off orientation.

14. The assembly as recited in claim 13 wherein said delivery conduit comprises an at least partially curved configuration extending along and substantially corresponding to a curved length of the toilet bowl, adjacent and beneath the outer rim of the bowl opening.

15. The assembly as recited in claim 13 wherein said delivery conduit comprises a substantially continuous, annular configuration extending along and substantially corresponding to a curved length of the toilet bowl adjacent and beneath the outer rim of the bowl opening.

16. The assembly as recited in claim 13 wherein said odor removal assembly comprises a removal conduit including a removal port, said removal conduit interconnecting said fan in fluid communication with the toilet bowl interior, said removal port disposed in fluid communication with the toilet bowl interior; said removal conduit and said removal port at least partially defining said air flow path.

17. The assembly as recited in claim 13 wherein said odor removal assembly further comprises a fan control operatively connected to said fan and selectively disposed in a fan-off condition and a fan-on condition.

18. The assembly as recited in claim 13 wherein said airflow path is operative to direct airflow in fluid communicating, at least partially drying relation to exposed portions of the user on the toilet bowl.

19. An assembly operative to cleanse an individual in use of a toilet bowl, said assembly comprising:

a delivery conduit connected to the toilet bowl in adjacent relation to a bowl opening, a spout structure disposed on said delivery conduit, said spout structure operative to direct a forced flow of fluid onto a portion of an individual exposed, through the bowl opening, an intake conduit disposed in interconnecting relation between said delivery conduit and a water supply, said intake conduit at least partially defining a path of fluid flow from the water supply to and through said delivery conduit, an odor removal assembly, including a negative pressure source, disposed in fluid communication with a toilet bowl interior, said odor removal assembly operative to define an airflow path from the toilet bowl interior to a toilet bowl exterior, and said airflow path operative to direct airflow in fluid communicating, at least partially drying relation to exposed portions of the user on the toilet bowl.

* * * * *